US006173062B1

(12) United States Patent
Dibachi et al.

(10) Patent No.: US 6,173,062 B1
(45) Date of Patent: Jan. 9, 2001

(54) FREQUENCY TRANSPOSITIONAL HEARING AID WITH DIGITAL AND SINGLE SIDEBAND MODULATION

(75) Inventors: Farid Dibachi, San Carlos, CA (US); Charles S. Richardson; Arnold S. Lippa, both of Tucson, AZ (US)

(73) Assignee: Hearing Innovations Incorporated, Tucson, AZ (US)

( * ) Notice: Under 35 U.S.C. 154(b), the term of this patent shall be extended for 0 days.

(21) Appl. No.: 08/214,169

(22) Filed: Mar. 16, 1994

(51) Int. Cl.[7] ..... H04R 25/00

(52) U.S. Cl. ..... 381/312; 381/316; 381/320

(58) Field of Search ..... 607/56, 57, 55; 381/68.2, 68.4, 68.3, 68, 67, 23.1, 312, 315, 316, 320, 321, 326; 455/109; 600/25

(56) References Cited

U.S. PATENT DOCUMENTS 4,051,331 * 9/1977 Strong ..... 381/68.4
4,156,116 * 5/1979 Yanick ..... 381/68.2
4,284,856 * 8/1981 Hochmair et al. ..... 607/57
4,419,544 * 12/1983 Adelman ..... 381/68.4
4,548,082 * 10/1985 Engebretson et al. ..... 381/68.2
4,686,705 * 8/1987 Smith ..... 455/109
5,047,994 * 9/1991 Lenhardt et al. ..... 381/68.3
5,285,499 * 2/1994 Shannon et al. ..... 381/68.3

* cited by examiner

*Primary Examiner*—Huyen Le
(74) *Attorney, Agent, or Firm*—Rothwell, Figg, Ernst & Manbeck

(57) ABSTRACT

Apparatus and method for shifting the frequency range of an audio frequency range signal using digital frequency shifting and single sideband amplitude modulation techniques. In one embodiment, a frequency shifted single sideband, amplitude modulated signal is formed for application to the human hearing sensory system to provide enhanced hearing for hearing impaired persons. In another embodiment, the audio signal is shifted to an ultrasonic frequency range utilizing digital signal processing techniques in which an audio frequency signal is frequency shifted by modulation to a carrier frequency and in which a single sideband modulated signal is formed. The digital single sideband amplitude modulation techniques of this embodiment are also applicable to digital modulation systems for uses other than in hearing aids. In another embodiment, analog single sideband modulation is utilized for frequency shifting in a hearing aid application.

15 Claims, 3 Drawing Sheets

FREQUENCY TRANSPOSITIONAL HEARING AID WITH DIGITAL AND SINGLE SIDEBAND MODULATION

The present invention relates to hearing aids for the deaf and the hearing impaired and, in particular, to hearing aid apparatus which utilizes a frequency transposition of signals from the audio frequency range to another frequency range, such as the ultrasonic frequency range, and vibratory transmission to the human sensory system of the frequency shifted signals as a means of communicating with the human sensory system. The present invention also pertains to the frequency shifting of audio frequency range signals from one frequency band to another whereby the audio frequency signals are converted to frequency ranges representing "islands of hearing" in which the hearing perception of certain hearing impaired persons is more acute than at other frequency ranges. The invention further pertains to a method and apparatus for forming a digital single sideband amplitude modulated signal.

BACKGROUND AND PRIOR ART

A hearing aid system of one general type to which the present invention relates is disclosed in U.S. Pat. No. 4,982,434—Lenhardt et al. In the referenced patent, there is disclosed a hearing aid system which utilizes such shifting of signals from the audio frequency range to the ultrasonic frequency range (referred to as "supersonic" frequency range in the patent), conversion of the shifted ultrasonic signal to a vibratory signal, and physical application of the vibratory signal to the human body for communication with the human sensory system. In one embodiment of the invention as disclosed in the referenced patent, an audio frequency signal is amplitude modulated onto an ultrasonic carrier signal for conversion to a vibratory signal and application to the body. In that embodiment, amplitude modulation is carried out by utilizing the analog audio signal as the modulating signal to modulate an analog ultrasonic carrier signal. In such a modulation system, an amplitude modulated signal with double (upper and lower) sidebands is derived.

The referenced system has provided excellent results in permitting the severely hearing impaired and even otherwise totally deaf persons to sense and understand audio frequency communications. It is an object of the present invention to provide even further improvements in systems of the aforementioned type and to provide as well improved apparatus and methods for shifting the frequency of audio frequency signals from one frequency band to another to improve the hearing response of hearing impaired persons who have a more acute hearing response in a frequency range which differs from the normal response in the audio frequency range. It is also an object of the present invention to provide improved digital apparatus and methods for single sideband amplitude modulation for hearing aid applications as well as other applications. Such digital frequency shifting may be either up or down in frequency from the normal audio frequency range and may be into the ultrasonic range as well into other frequency ranges depending upon the hearing response characteristics of the subject.

SUMMARY OF THE INVENTION

The present invention provides further improvements in systems of the aforementioned type by providing a digital system for shifting the frequency of audio signals.

In one embodiment thereof, an apparatus and method in which amplitude modulation utilizing only a single sideband is employed. As will be more fully explained below, it has been discovered that the physiology of the human sensory system is more responsive to a single sideband amplitude modulated signal than a double sideband amplitude modulated signal. The apparatus and method of the present invention also provide improved digital signal processing apparatus and methods for deriving such a single sideband amplitude modulated signal in an efficient manner with a high quality, virtually distortion free and noise free signal. In forming such a high quality digital single sideband modulated signal, the apparatus and method of the present invention function to eliminate signal anomalies which otherwise occur in the digital signal and which deteriorate the quality of the signal. Such improved apparatus and methods are applicable to frequency shifting in hearing aids as well as other applications as will be more fully explained below. In one embodiment of the present invention where only the upper sideband was utilized and the lower sideband was suppressed by more than 60 dB, significant improvements in performance in a hearing aid apparatus were realized.

In addition, the apparatus and method of the present invention utilize an all digital processing technique, which offers advantages in providing freedom from problems common to analog systems such as drift, temperature dependent characteristics and changes in parameters and characteristics with age. In the apparatus and method of the present invention, a digital single sideband amplitude modulated signal is formed in which certain signal anomalies which otherwise cause deterioration in the quality of the signal are virtually eliminated, thus producing a high quality single sideband amplitude modulated signal in digital form.

The digital system of the present invention thus provides a high quality signal which is virtually distortion free and noise free. In addition, the all digital processing system of the present invention allows mechanization of the functions of the system in a more flexible design environment in which different parameters of the signal processing procedures may be adjusted for optimum performance. Further, mechanization of and modifications to the signal processing algorithms, including customization of the same for special applications, can be implemented through software and firmware and through relatively easy to make changes in these elements.

The present invention also provides an improved method and apparatus for translating audiometric frequencies from the normal hearing range to other frequency bands, such as to an ultrasonic frequency band, and, in the process of translation from one frequency band to another, of adjusting the bandwidth of the audiometric signal. For example, when the audiometric signal is translated to a higher frequency, such as to an ultrasonic frequency, the bandwidth of the audiometric signal can be expanded to provide a greater frequency range for the information signal at the higher frequency. This will be beneficial for some users in providing a wider frequency range for the "just noticeable difference" response of the hearing mechanism at the higher frequency range.

Other objects and advantages of the present invention will be apparent from the detailed description which follows, taken in connection with the accompanying drawings.

DETAILED DESCRIPTION OF THE INVENTION

Figure 1:
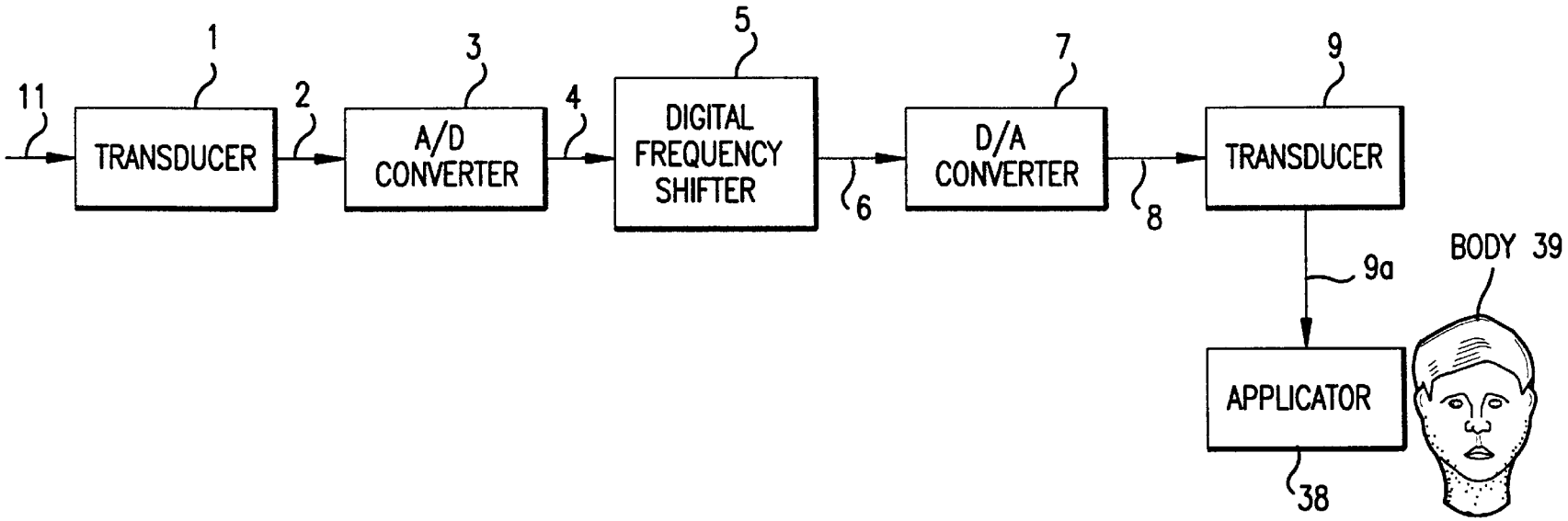
FIG. 1 is a block diagram of one embodiment of the system of the present invention.

Referring now to FIG. 1, there is shown a system block diagram of one embodiment of the present invention in which a transducer 1 transposes an audio frequency airborne signal, such as a voice signal 11, into an analog electrical signal 2. The voice signal 11 may also, of course, be any audio frequency information signal containing information of any kind represented in the form of audio frequency signals intended to be communicated to a human subject.

In order to perform the frequency conversion or shift in a digital format, the analog audio frequency signal 2 is first converted into digital form by means of an analog to digital converter 3 to yield a digital audio frequency signal 4.

The digital audio frequency signal 4 is then transposed or converted to a translated digital signal 6 at a different frequency by digital frequency shifter 5. Digital frequency shifter 5 may operate using various known digital frequency conversion or shifting techniques. Such techniques include amplitude modulation of a carrier signal and "Fast Fourier Transforms" to derive numerically the Fourier transforms of the component frequencies of a signal for enabling frequency translation and other operations to be performed.

Translated digital signal 6 is converted into an analog signal 8 by a digital to analog (D/A) converter 7. The analog output signal 8 is then applied to a transducer 9 which generates a mechanical vibration signal 9*a* responsive to the analog signal 8 for application in the form of vibrations through an applicator 38 to the human sensory system such as a body portion 39.

In general the digital frequency shifter 5 performs the function of multiplying the digitized audio signal 3, by a transfer function to shift the signal to a different frequency. The transfer function may also expand, contract or maintain the bandwidth of the original signal.

Figure 2:
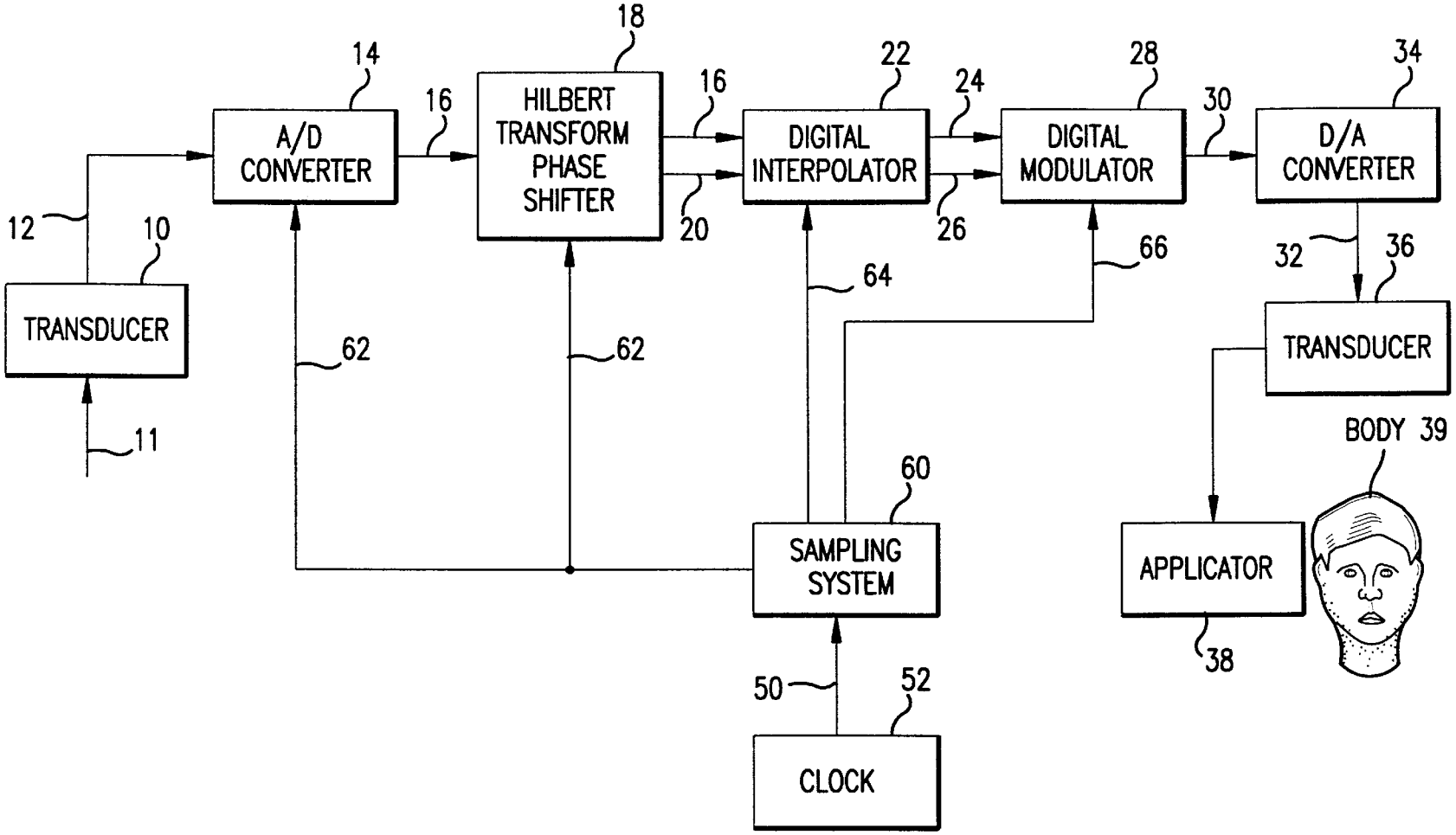
FIG. 2 is a more detailed block diagram of one embodiment of the system of the present invention.

Referring now to FIG. 2, there is shown a more detailed system block diagram of one embodiment of the present invention in which a transducer 10 transposes an audio frequency airborne signal, such as a voice signal 11, into an analog electrical signal 12. The voice signal 11 may also, of course, be any audio frequency information signal containing information of any kind represented in the form of audio frequency signals intended to be communicated to a human subject.

For the purposes of the present invention, the analog audio frequency signal 12 is to be upshifted in frequency by means of amplitude modulation to a higher frequency carrier signal which, in the embodiment of FIG. 2, is preferably an ultrasonic frequency carrier signal. The analog audio frequency signal 12 may be represented as a function of time as x(t) and the carrier signal as $\omega_c$. To form directly an upper sideband modulated signal Xc(t) in which the carrier $\omega_c$ is modulated by x(t), the following mathematical relationship applies:

$$Xc(t)=x(t)\cos\omega_c t-\hat{x}(t)\sin\omega_c t \quad (1)$$

Where:

| | |
|---|---|
| t | is time |
| Xc(t) | is the modulated frequency upshifted signal |
| x(t) | is the audio signal 12 |
| $\hat{x}(t)$ | is x(t) shifted by 90° |
| $\omega_c$ | is the carrier or upshift frequency in radians/sec. |

It will be observed from equation (1) that the elements of the equation must be computed and the operations performed in accordance with the equation to yield the single sideband modulated upshifted signal Xc(t). As set forth in equation (1), Xc(t) is an upper sideband modulated signal. A lower sideband signal may instead be formed by using the appropriate mathematical relationship of the elements. Thus, in accordance with the present invention, the signal Xc(t) may be single sideband modulated utilizing either the upper or the lower sideband. As noted above, in the embodiment presented, the signal Xc(t) is modulated with the upper sideband.

In order to perform in a digital format the operations as set forth in equation (1), the analog audio frequency signal 12 is first converted into digital form by means of an analog to digital converter 14 to yield a digital audio frequency signal 16. The signal 16 is transformed by a phase shifter 18 into a pair of signals, one of which remains the original signal 16 and the other of which is a 90° phase shifted signal 20. That is, signal 16 at the output of the phase shifter 18 is the digital audio signal x(t) and the signal 20 is the 90° phase shifted signal $\hat{x}(t)$.

In the embodiment illustrated in FIG. 2, the phase shifter 18 is a Hilbert transform phase shifter, which is well known in the art. In the embodiment shown in FIG. 2, the phase shifter 18 used a 799-tap finite impulse response (FIR) filter with Hilbert transform techniques. The amount of the phase shift is exactly 90°. However, the amplitude of the phase shifted signal varies as a function of frequency. As is the case with any complex signal, the signal 16, x(t), typically contains a number of frequency components. To maintain a high degree level of lower sideband suppression of the single sideband modulated signal Xc(t), the balance between the two terms on the right hand side of equation (1) must be maintained.

In order to maintain this balance, the amplitude variations of the phase shifted signal $\hat{x}(t)$ must be minimized. The amount of the variation is a function of the sampling frequency which is used to digitize the analog signal 12. In addition, such variations in amplitude are milder in the region where the input signal frequency is closer to the Nyquist rate (i.e., one-half the sampling frequency).

The sampling rate of the A/D converter 14 is selected dependent on the bandwidth of the input audio signal 12. In a telephone conversation, the speech signal is treated as having a bandwidth of 300 Hz to 3 kHz. In high fidelity audio systems, music is typically treated as having a bandwidth of 15 Hz to 20 kHz. In the embodiment of the invention herein presented, signal 12 is assumed to be a speech signal with a bandwidth of from about 300 Hz to 5 kHz. Based on this assumption, a sampling rate of 14.0 kHz was chosen to digitize the incoming speech signal 12.

The digital speech signal 16 and the 90° phase shifted digital signal 20 are introduced into a digital interpolator 22 which produces output signals 24 and 26, which are then supplied to a digital modulator 28 for amplitude modulation of the carrier or upshifted frequency signal. A single sideband, amplitude modulated digital output signal 30 is produced by the digital modulator 28. The digital modulated signal 30 is converted into an analog signal 32 by a digital to analog (D/A) converter 34. The analog output signal 32 is then applied to a transducer 36 which generates the mechanical vibration signal responsive to the analog signal 32 for application through an applicator 38 in the form of vibrations to the human sensory system such as a body portion 39.

The mechanical vibration signal applied by the applicator 38 to the body portion 39 may be of any physical form suitable for application to the human body to create a physical stimulus and may thus include physical ultrasonic wave pulsations transmitted a short distance through the air by the applicator 38 to physically impact the target portion of the body to which the vibratory signal is to be applied. For example, the applicator 38 may be in the form of a speaker which creates physical vibrations in the air, which vibrations are transmitted in wave form through the air to impact a selected portion of the body which has been determined to be responsive to physically applied vibrations. In such a case, the vibrations are directly physically applied to the selected portion of the human body by means of the interaction with and the resultant vibratory impact on the selected human body portion of the frequency shifted vibrations transmitted as waves through the air as a medium. The terms "applicator" and "applicator means" as used herein include all such apparatus.

A system clock signal 50 is generated by a clock 52 which, in the embodiment presented, includes a 10 MHz crystal oscillator for generating a base frequency. The sampling rates of the phase shifter 18, the digital interpolator 22 and the digital modulator 28 are controlled by a sampling system 60, which is supplied with the clock signal 50 by the clock 52 and which generates sampling signal timing inputs 62, 64 and 66 respectively for these elements.

The digital interpolator 22 performs an important function in eliminating signal anomalies, particularly intermodulation products, as will now be explained.

In the embodiment of FIG. 2, the frequency of the frequency upshifting carrier signal is selected in the ultrasonic frequency range at 28 kHz. As used herein, the term "ultrasonic" refers to frequencies which are above the normal human hearing range, the upper limit of which is generally accepted to be about 20 kHz. The carrier itself is a periodic signal preferably of a sinusoidal shape. The frequency of the frequency upshifting carrier signal may be selected at a frequency other than in the ultrasonic range if it is desired to shift the frequency of the audio signal to another frequency range, even within the normal audio range, using the apparatus and methods of the present invention.

As noted above, the sampling rate of the A/D converter 14 for an input bandwidth of 300 to 5,000 Hz was selected at 14.0 kHz for the embodiment of FIG. 2. Since a carrier frequency of 28 kHz was selected, the sampling rate at the output of the digital modulator must be at least equal to the carrier frequency of 28 kHz. In order to obtain a low distortion signal without the need for a high performance analog filter, an effective output sampling rate from the digital interpolator 28 of about 112 kHz, four times the carrier frequency of 28 kHz, was selected. The basis for that selection will now be explained.

Because of the substantial differences between the sampling frequency rates at the input and output as described above, a multi-rate digital signal processing system is employed in the embodiment of FIG. 2. Sampling the input signal at a different rate than the output signal results in various anomalies associated directly with digital signal processing and the resulting intermodulation products. These fall into two distinct problem areas.

The first of these relates to audio intermodulation products of the sampled input signal and the sampled carrier signal at the output, which appear in the form of audio signals. Such audio signals can not only deteriorate the performance of the digital single sideband modulator 28 but can also have a detrimental effect on the performance of the hearing aid system by, for example, interfering with the performance of the transducer 36.

The following is a mathematical analysis of the aforementioned audio intermodulation products. The sample speech signal 16 may be represented as:

$$n_{sig}f_{ss}\pm f_{sig}\ (n_{sig}=0,1,2,\ldots) \tag{2}$$

where:

| | |
|---|---|
| $n_{sig}$ | is the harmonic number of the sampling frequency |
| $f_{ss}$ | is the sampling frequency of the input signal |
| $f_{sig}$ | is the signal frequency |

The sampled carrier may be represented as:

$$n_c f_{sc}\pm f_c\ (n_c=0,1,2,\ldots) \tag{3}$$

where:

| | |
|---|---|
| $n_c$ | is the harmonic number of the sampling frequency of the carrier signal |
| $f_{sc}$ | is the sampling frequency of the carrier signal |
| $f_c$ | is the frequency upshifting carrier signal frequency |

Equations (2) and (3) may be combined to take into account the effects of modulation. The following expression is a representation of all frequency components resulting from the modulation of $f_c$ by $f_{sig}$.

$$f_{out}=(n_c f_c\pm f_c)\pm(n_{sig}f_{ss}\pm f_{sig}) \tag{4}$$

When using the fundamental carrier frequency (i.e., $n_c=0$), if the condition $$f_c=n_{sig}f_{ss} \tag{5}$$

is satisfied, a spurious intermodulation signal appears at the output with its frequency equivalent to $f_{sig}$ (i.e., the input signal), namely:

$$f_{out}=f_{sig}$$

In the ultrasonic hearing system, this audio output signal translates to a distortion and causes a deterioration in performance of the system as well as in the performance of the output transducer 36.

In the present invention, the appearance of this signal is avoided by selecting the carrier frequency $f_c$ and the sampling frequency of the input signal such that $f_c$ is not an integral multiple of the sampling frequency of the input signal. For example, if the sampling frequency were to be selected at 14 kHz, that is $f_{ss}$=14 kHz, a carrier frequency of 28 kHz, or any other integer multiple of $f_{ss}$, must be avoided.

The second anomaly consists of lower sideband intermodulation products. From the discussion above, it has been determined that the sampling frequency of the input signal should be larger than the frequency upshifting carrier signal frequency. Since the embodiment presented is a digital system, "larger" may not be less than two. Thus:

$$f_{ss}=2f_c \tag{6}$$

satisfies this requirement.

Again, using equation (4) with:

$$n_c=0,$$

and $$n_{sig}=1$$

it can then be said:

$$-f_c+(2f_c-f_{sig})=f_c-f_{sig} \tag{7}$$

Equation (7) is descriptive of a lower sideband intermodulation product. The lower sideband intermodulation product is precisely in the region which must be eliminated in order to arrive at an upper sideband modulated signal with a highly suppressed lower sideband. The effect just described is therefore highly undesirable.

This result is avoided in the present invention by selecting the ratio of the input sampling frequency $f_{ss}$ to the carrier frequency $f_c$ to an even larger value of four, so that equation (6) then becomes:

$$f_{ss}=4f_c \tag{8}$$

According to equation (8), for the embodiment of the present invention illustrated in FIG. 2, where the carrier frequency $f_c$ of the frequency upshifting carrier signal was chosen at 28 kHz, the input sampling rate $f_{ss}$ should be equal to 112 kHz, i.e., four times the carrier frequency $f_c$.

However, at an input sampling rate of 112 kHz, the performance of the required phase shift requires significant processing power. A lower sampling frequency for the input signal is therefore desirable. In addition, due to the behavior of the Hilbert transform algorithm, the performance of the phase shifter 18 is not as good as in the case where the sampling rate is lower.

Accordingly, in the embodiment of FIG. 2, the Hilbert Transform is performed in Hilbert transform phase shifter 18 at the much lower frequency of 14 kHz and the effective sampling rate of digital signals 16 and 20 is then increased by digital interpolation before the signals are present to digital modulator 28. In the present embodiment, the frequency of the input waveform of signals 24 and 26 to the digital modulator 28 is selected to be eight times the initial sampling frequency of 14 kHz, that is, 112 kHz.

The function of increasing the effective sampling rate is performed by the digital interpolator 22. The digital interpolator functions to insert between the sampling points of the sampled input signals 16 and 20 additional sampled value points derived by way of interpolation so that the effective sampling rate is thus increased. In the embodiment shown in FIG. 2, the effective input sampling rate at the A/D converter 14 is increased by a factor of eight times the input sampling rate to the digital interpolator 22.

Figure 3:
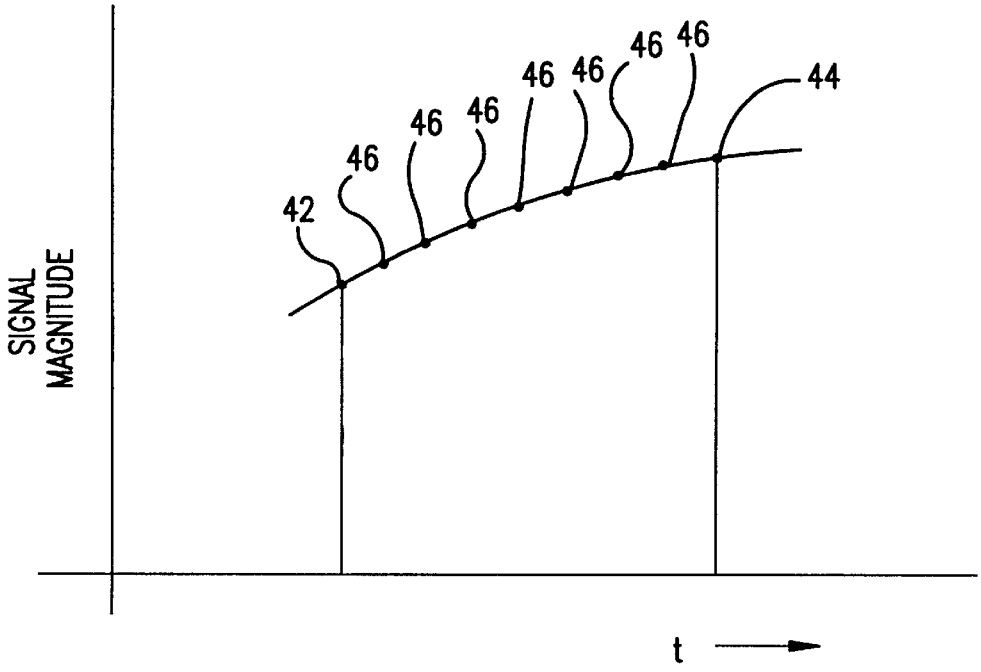
FIG. 3 is a graphical representation of signal magnitude as a function of time illustrating the digital interpolation function embodied in the present invention.

The effect of this process is shown in FIG. 3 in which a portion of a sampled waveform 40 is illustrated as a function of time. Sampling points 42 and 44 represent the points sampled at the sampling rate of the A/D converter 14. The interpolator functions to derive interpolated values 46 between the sampled points 42 and 44 using a suitable interpolation algorithm, a number of which are well known in the art.

In order to increase the effective sampling rate to eight times that of the A/D converter 14, seven intermediate interpolated sampled values 46 are inserted between sampling points 42 and 44, so that eight sampling points are now effectively attained for each one original sampling point of the A/D converter 14. While any suitable interpolation algorithm may be used, in the embodiment of FIG. 2 a so-called "spline" interpolator, well known to those skilled in the art, is utilized as the digital interpolator 22. The interpolated sampled values 46 are calculated from the interpolation algorithm in this case using 136 consecutive sampling points of the A/D converter 14.

The interpolator 22 thus functions to insert seven interpolated sampled values between each pair of sampling points of the A/D converter 14, thereby multiplying the input sampling frequency by a factor of eight and attaining an effective sampling rate of eight times that of the input signals 16 and 20 to the interpolator 22. For the embodiment presented, the effective input sampling frequency of the signals 24 and 26 at the input to the digital modulator 28 is thus 112 kHz for a sampling frequency of 14 kHz of the A/D converter 14.

Selection of the various frequencies in accordance with the foregoing principles avoids the occurrence of the above-described anomalies in the output signal. It is to be understood, of course, that any suitable ultrasonic carrier frequency other than that used for the purposes of describing the present embodiment may be selected and that the sampling rates for the functions of the interpolator 22 and the digital modulator 28 may then be made accordingly based on the teachings set forth herein. Because of the advantages which are attained from the avoidance of these anomalies, the digital modulation apparatus and method of the present invention are also applicable as well to digital modulation systems other than those intended for use in hearing aids.

The transducer 36 generates a mechanical vibratory output signal 38 which is physically applied through applicator 38 to a portion of the human body 39 for transmission within the body to sensory elements capable of extracting the modulated audio frequency signal information. As used herein, the term "information" includes "speech" as well as other forms of information represented by audio frequency signals such as tonal patterns and/or multi-tone signals and the like or even music to the extent that such signals fall within the normal audio frequency range which has an upper limit of about 20 kHz. As pointed out in the above referenced U.S. Pat. No. 4,982,434, it has been discovered that the human sensory system is capable of sensing and extracting information present in such audio frequency signals when such signals are upshifted in frequency to the ultrasonic frequency range, such as by means of modulating an ultrasonic carrier with such audio frequency signals, and applied to the body in the form of a mechanical vibratory signal.

In the present invention, an ultrasonic carrier signal is amplitude modulated with such audio frequency signals with one sideband being suppressed to form a single sideband amplitude modulated signal. As pointed out above, it has been discovered that an amplitude modulated single sideband ultrasonic signal is more effective in this type of hearing aid apparatus than a double sideband signal of the prior art. In addition, the performance of the modulation functions by digital signal processing yields other advantages as well, as is also pointed out above. In the embodiment of FIG. 2, and using the techniques disclosed herein for suppression of anomalies, the lower sideband was suppressed to better than 60 dB and significant improvements in performance were realized.

The present invention may also be utilized in the digital mode to form a double sideband amplitude modulated signal. This can be done by utilizing the embodiment of FIG. 2 without the phase shifter 18 with the single signal 16 being supplied to the digital modulator 28 to form a double sideband amplitude modulated signal. In this embodiment, the digital interpolator 22 can still be used to increase the effective sampling rate of the A/D converter 14.

Figure 2A:
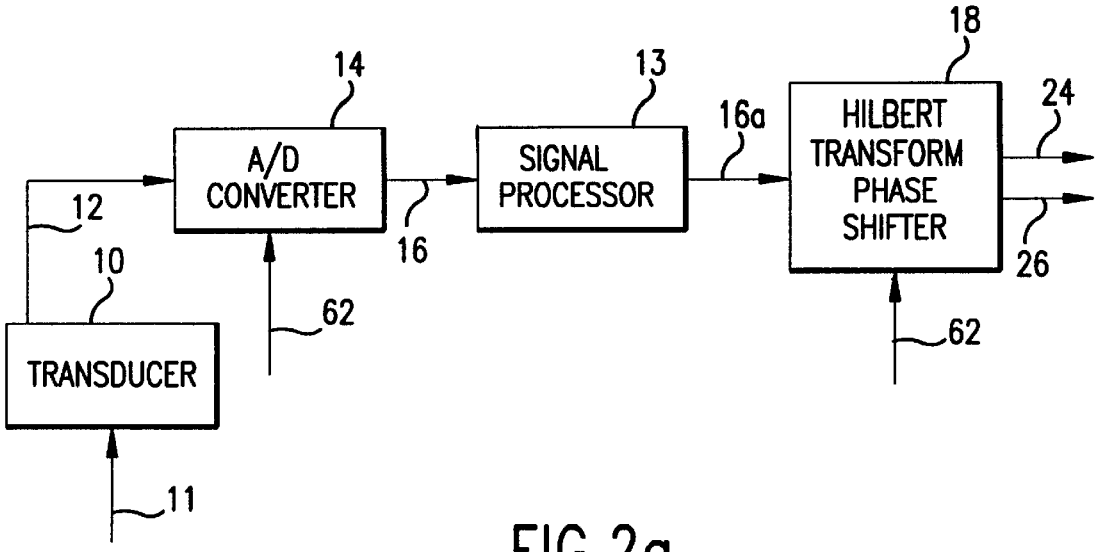
FIG. 2A is a block diagram of a modified portion of the embodiment of FIG. 2 showing a modification to provide for signal processing of the audio frequency signal as it is frequency upshifted.

In another embodiment of the present invention illustrated in FIG. 2A, the electrical audio signal 12 is processed through a signal processor 13 to form a processed signal 16*a* for delivery to the Hilbert transform phase shifter 18. The signal processor 13 functions to improve the quality of the audio signal 12, such as by filtering out noise components and other disturbances and performing other signal processing functions. The remainder of the circuit of FIG. 2A is the same as and operates in the same manner as the embodiment shown in FIG. 1.

The signal processor 13 also functions in selected applications to expand the bandwidth of the audio frequency information signal as it is shifted to a higher frequency range in order to provide a wider difference in the frequency bandwidth of the audio information signal relative to the shifted frequency for purposes of facilitating detection of "just noticeable differences" between the adjacent frequencies in the information signal. The signal processor 13 thus produces an expanded bandwidth signal 16*a* in such applications. It has been found that such expansion in frequency bandwidth of the audio frequency information signal facilitates better detection of the frequency differences in the information signal at the shifted higher frequencies for some users of the hearing aid equipment. The amount of the bandwidth expansion can be selected to optimize the response in individual cases.

The expansion of the bandwidth of the audio frequency information signal is preferably effected before the frequency shift of the information signal to the higher frequency range. Where the frequency shift is effected by amplitude modulation of a higher frequency carrier signal, the bandwidth of the audio frequency information signal is expanded prior to the modulation of the carrier.

The expansion of the bandwidth of the audio frequency signal information signal may be effected by techniques known in the art. Examples of such techniques are shown in U.S. Pat. No. 4,419,544—Adelman and U.S. Pat. No. 4,051,331—Strong. As disclosed in the referenced Adelman patent, harmonic transposition of frequencies from one frequency band to another is accomplished by selective multiplication or division of all component frequencies by a constant value. Such bandwidth expansion may also be accomplished by means of "Fast Fourier Transforms" to derive numerically the Fourier transforms of the component frequencies of the audio frequency signal for enabling frequency translations to be performed in a well known manner such as described in the aforementioned Adelman and Strong patents.

Such Fast Fourier Transform techniques are described, for example, in the book "Introduction to Communication Systems" Second Edition, by Ferrel G. Stremler, published in 1982 by Addison-Wesley Publishing Company, dealing with Fast Fourier Transform (FFT) techniques. As noted on pages 136–141 of the aforementioned book, the commonly used Cooley-Tukey FFT algorithm computes N discrete frequency components from N discrete time samples of a signal, where N is any selected number which is an integer power of 2. The specifics of the FFT techniques using this algorithm are described in detail in the referenced portion of the text, the subject matter of which is incorporated herein by reference.

It is to be understood that the embodiments set forth herein are described in detail for purposes of providing a full and complete disclosure of the best mode of the present invention and of practicing the same, and that such detailed disclosure is therefore not to be interpreted as in any way limiting the scope of the present invention as defined in the appended claims. Various modifications and substitutions falling within the scope of the teachings set forth herein and within the scope of the appended claims will therefore occur to those skilled in the art.

What is claimed is:

1. A hearing aid apparatus for receiving and transmitting to the human sensory system information contained in an audio frequency signal for enabling human sensing of information contained in said audio frequency signal, comprising:

first transducer means for receiving and converting an audio frequency sound signal into an audio frequency electrical signal;

analog to digital converter means for converting said audio frequency electrical signal to a digital audio frequency electrical signal;

frequency shifting means for shifting the frequency band of said digital audio frequency electrical signal from its original frequency band to a different selected frequency band to form a digital frequency shifted electrical signal, including modulation means for modulating said digital audio frequency electrical signal onto a carrier signal to form said digital frequency shifted electrical signal, and means for forming a digital single sideband amplitude modulated frequency shifted signal from said digital frequency shifted electrical signal;

digital to analog converter means for converting said digital single sideband amplitude modulated frequency shifted electrical signal to an analog frequency shifted electrical signal;

second transducer means for converting said analog frequency shifted electrical signal into a sensory signal for application to a portion of the human body; and applicator means for applying said sensory signal to the human sensory system through physical interaction with the human body.

2. A hearing aid apparatus as set forth in claim 1 wherein said different selected frequency band is an ultrasonic frequency band.

3. A hearing aid apparatus for receiving and transmitting to the human sensory system an audio frequency signal for enabling human sensing of information contained in said audio frequency signal comprising:

first transducer means for receiving and converting an audio frequency sound signal into an audio frequency electrical signal;

analog to digital converter means for converting said audio frequency electrical signal to a digital audio frequency electrical signal;

digital modulation means for amplitude modulating said digital audio frequency electrical signal onto an ultrasonic frequency electrical carrier signal to form a digital amplitude modulated electrical signal having two sidebands, including means for suppressing one of the sidebands of said digital amplitude modulated electrical signal whereby said digital amplitude modulated electrical signal is formed as a digital single sideband amplitude modulated electrical signal;

digital to analog converter means for converting said digital single sideband amplitude modulated electrical signal to an analog amplitude modulated electrical signal;

second transducer means for converting said analog amplitude modulated electrical signal into a sensory signal for application to a portion of the human body; and means for applying said sensory signal to the human sensory system through physical contact with the human body.

4. A hearing aid apparatus for receiving and transmitting to the human sensory system an audio frequency signal for enabling human sensing of information contained in said audio frequency signal comprising:

first transducer means for receiving and converting an audio frequency sound signal into an audio frequency electrical signal;

analog to digital converter means for converting said audio frequency electrical signal to a digital audio frequency electrical signal at a selected base sampling frequency of said analog to digital converter means;

digital interpolator means for increasing the effective sampling frequency of said digital audio frequency electrical signal to a frequency higher than said base sampling frequency to thereby form an increased sampling frequency digital audio frequency signal;

digital modulation means for amplitude modulating said increased sampling frequency digital audio frequency electrical signal onto a frequency upshifting electrical carrier signal to form a digital amplitude modulated electrical signal;

digital to analog converter means for converting said digital amplitude modulated electrical signal to an analog amplitude modulated electrical signal;

second transducer means for converting said analog amplitude modulated electrical signal into a vibratory signal; and means for applying said vibratory signal to the human sensory system through physical contact with the human body.

5. A hearing aid apparatus as set forth in claim 4 wherein said frequency upshifting electrical carrier signal is an ultrasonic frequency signal.

6. A hearing aid apparatus as set forth in claims 4 or 5 wherein said digital modulation means includes means for suppressing one of the sidebands of said digital amplitude modulated electrical signal whereby said digital amplitude modulated electrical signal is formed as a digital single sideband, amplitude modulated electrical signal.

7. A hearing aid apparatus as set forth in claim 4 including means for setting the increased effective sampling frequency of said digital modulator means to a frequency higher than the frequency of said ultrasonic frequency electrical carrier signal.

8. A hearing aid apparatus as set forth in claim 7 wherein said increased effective sampling frequency of said analog to digital converter means is an integer multiple of the frequency of said ultrasonic frequency electrical carrier signal.

9. A hearing aid apparatus as set forth in claim 8 wherein said integer multiple of the frequency of said ultrasonic frequency electrical carrier signal is four or greater.

10. Apparatus for forming a digital single sideband amplitude modulated signal modulated with a modulating signal initially in analog form comprising:

analog to digital converter means for converting said analog signal to a digital signal at a selected base sampling frequency of said analog to digital converter means;

digital interpolator means for increasing the effective sampling frequency of said digital signal to a frequency higher than said base sampling frequency to thereby form an increased sampling frequency digital signal;

digital modulation means for amplitude modulating said increased sampling frequency digital signal onto a carrier signal to form a digital amplitude modulated electrical signal;

said digital modulation means including means for suppressing one of the sidebands of said digital amplitude modulated electrical signal whereby said digital amplitude modulated electrical signal is a digital single sideband, amplitude modulated electrical signal; and means for setting the sampling frequency of said increased sampling frequency of said digital interpolator means to an effective sampling frequency higher than the frequency of said carrier signal.

11. Apparatus for forming a digital single sideband amplitude modulated signal as set forth in claim 10 wherein the frequency of said increased sampling frequency digital signal is an integer multiple of the frequency of said carrier signal.

12. Apparatus for forming a digital single sideband amplitude modulated signal as set forth in claim 11 wherein said integer multiple is four or greater.

13. A hearing aid apparatus as set forth in claims 1, 3, 4 or 10 further comprising a signal processor for modifying said audio frequency electrical signal to improve the clarity of perceived hearing of the user.

14. A hearing aid apparatus as set forth in claim 13 wherein said signal processor includes means for adjusting the bandwidth of said audio frequency electrical signal.

15. The hearing aid apparatus of claim 14 wherein said bandwidth adjusting means includes means for expanding the bandwidth of said audio frequency electrical signal.

* * * * *